United States Patent [19]

Carter et al.

[11] Patent Number: 4,656,909

[45] Date of Patent: Apr. 14, 1987

[54] METHOD AND APPARATUS FOR PRODUCTION OF ONION RINGS

[75] Inventors: Scott K. Carter, Meridian; George A. Mendenhall, Boise, both of Id.

[73] Assignee: GME, Inc., Boise, Id.

[21] Appl. No.: 816,167

[22] Filed: Jan. 3, 1986

[51] Int. Cl.[4] ..... B26D 3/28; B26D 7/06

[52] U.S. Cl. ..... 83/874; 83/44; 83/98; 83/402; 83/444

[58] Field of Search ..... 83/402, 24, 98, 99, 83/444, 449, 450, 864, 870, 39, 874, 44

[56] References Cited

U.S. PATENT DOCUMENTS 4,082,024 4/1978 Hodges et al. ..... 83/402

4,423,652 1/1984 Winslow ..... 83/402 X

*Primary Examiner*—James M. Meister

*Attorney, Agent, or Firm*—Paul F. Horton

[57] ABSTRACT

Method and alignment tube apparatus for the production of onion rings in an hydraulic food cutting system. Onions are pre-cut at top and bottom to provide an onion having a predetermined thickness. The onions so cut are then propelled through a flow tube which aligns the onion into a preselected position relative to cutting knives. The onion is then forced by hydraulic pressure through the cutting knives, which are horizontally oriented and vertically stacked, to cut the concentric layers of onion into onion rings. The alignment tube of the present invention includes a pair of oppositely disposed converging ramps which define an outlet port having an height substantially the same as the thickness of the precut onion. The onion is thereby precisely oriented for proper cutting.

14 Claims, 5 Drawing Figures

METHOD AND APPARATUS FOR PRODUCTION OF ONION RINGS

BACKGROUND OF THE INVENTION

1. Field of the Invention

This invention relates to a method for producing onion rings by use of an hydraulic food cutting system and an alignment tube for proper and precise orientation of the onion for cutting.

2. Description of the Prior Art

Food cutters utilizing hydrualic singularizing and propelling apparatus is well known in the art, such apparatus being typified by the early inventions of F. G. Lamb et al, U.S. Pat. Nos. 3,108,625; 3,109,468; and 3,116,772; the later inventions of J. L. Hodges, U.S. Pat. Nos. 4,082,024 and 4,135,002; and the even more recent cutting assembly of W. I. Fisher et al, U.S. Pat. No. 4,372,184 and potato centering device of E. D. Winslow, U.S. Pat. No. 4,423,652. Such apparatus is used exclusively for the centering and aligning of potatoes and have no structure for the alignment and correct positioning of pre-cut onions for the production of onion rings.

For the production of onion rings, onions, heretofore, have been sliced by machines which hold the onions in place during the cutting procedure, such machines being typified by U.S. Pat. Nos. 2,961,023 and 3,722,339 issued to E. F. Boyer and U.S. Pat. No. 3,537,494 issued to G. J. Orlowski. Orlowski also shows a separator for onions so sliced in his U.S. Pat. No. 3,534,792.

SUMMARY OF THE INVENTION

The method of producing onion rings herein presented renders obsolete the prior methods of producing onion rings in that the method of the present invention considerably accelerates the production while producing onion rings of a high standardized quality. In being considerably faster than existing methods, the production becomes much more cost efficient and, in that the onions are cut at a proper angle relative to the concentric layers of onion surrounding the longitudinal axis of the onion, ie., substantially transverse to the longitudinal axis, greater quality control is obtainable.

The alignment tube of the present invention permits, even requires, precise orientation of the onion as it is fed into the horizontally oriented, vertically stacked cutting knives of the hydraulic cutting apparatus while simultaneously singularizing the onions for cutting.

In utilizing the method of the present invention, an onion is first peeled and pre-cut at top and bottom to define an onion having a predetermined thickness. The onion is then propelled by a pump, under hydraulic pressure, through the alignment tube of the present invention for proper orientation relative to the cutting knives. The alignment tube includes in its interior a pair of oppositely disposed ramps which converge from adjacent the inlet of the tube to define an outlet port which is only slightly greater in height that the thickness of the precut onion. As the onion progresses down the length of the alignment tube, the ramps precisely align the onion relative to the cutting knives or blades for the cutting of onion rings from the concentric layers of onion. A more thorough description of the invention may be found in the appended claims.

It is therefore a primary object of the present invention to provide a method for producing onion rings which is considerably faster and more cost efficient than existing methods.

It is also an object of the present invention to provide a method for producing onion rings which produce rings of standard cut and of high quality.

More particularly, it is an object of the present invention to provide a method for the production of onion rings which utilizes hydraulic propulsion for the alignment and cutting of onion rings.

A second primary object of the present invention is to provide an alignment tube for aligning onions, pre-cut on top and bottom, relative to cutting knives for the production of onion rings.

A further object of the present invention is to provide an alignment tube which includes a pair of oppositely disposed internal ramps which converge from adjacent the inlet of the tube to the outlet of the tube to define an outlet port having an height substantially equal of the thickness of the precut onion.

Additional objects and advantages will become apparent and a more thorough and comprehensive understanding may be had from the following description forming a part of this specification.

DETAILED DESCRIPTION OF THE INVENTION

Figure 1:
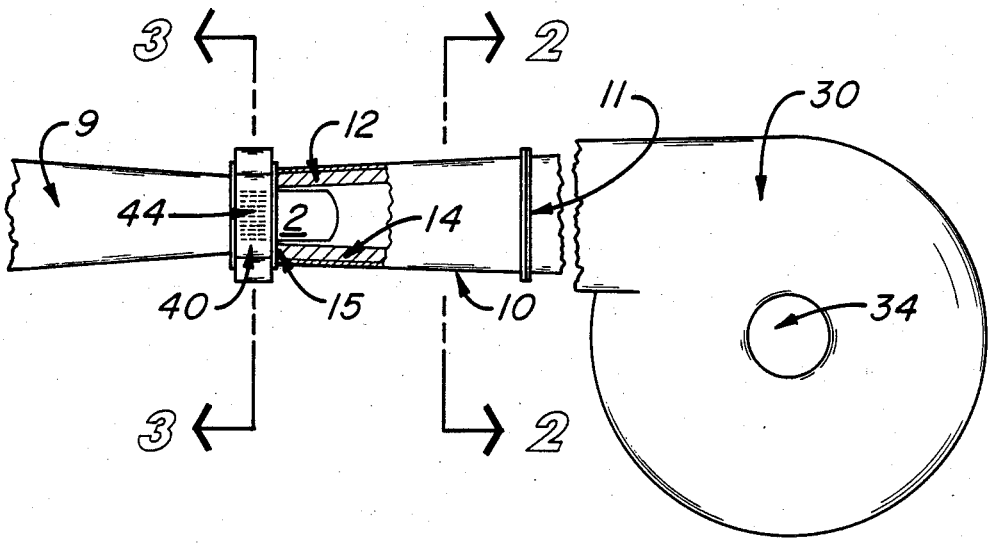
FIG. 1 is a side view in partial section of food cutting apparatus utilizing the alignment tube of the present invention.
Figure 2:
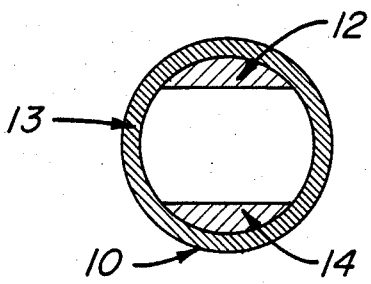
FIG. 2 is a cross-sectional view of the tube taken along lines 2—2 of FIG. 1.
Figure 3:
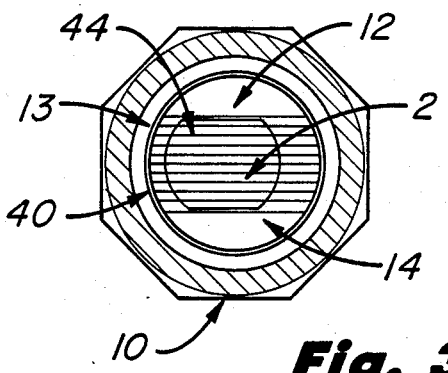
FIG. 3 is an end view of the cutter showing the relationship between the exit port of the alignment tube, the onion, and the cutting knives of the cutter.

Referring now to FIGS. 1, 2, and 3, a preferred embodiment of an onion aligning tube 10 made according to the present invention is disclosed. The aligning tube 10 is used in conjunction with hydraulic food product cutting apparatus including a pump 30 and a cutter 40. Pump 30 includes an inlet 34 for the intake of onions and the carrying medium, water. The pump propels the water and onions into alignment tube 10 of the present invention and then through cutter 40 for the production of onion rings. From cutter 40, the onion rings are conveyed by tube 9 into a separator, not shown, where the onion rings are separated from the water for further processing.

Before the onion is fed into pump 30, the onion is peeled and topped and bottomed to produce onions, each having a preselected standardized thickness from top to bottom. In this initial cutting phase, the onion is first oriented about its longitudinal axis and then cut both top and bottom substantially transverse to this axis so that both top and bottom of the onion have planar surfaces which are parallel to one another.

The onions, so cut, are then placed into water and fed into pump 30 through inlet 34. The pump propels both water and onions under hydraulic pressure into alignment tube 10 of the present invention.

Figure 4:
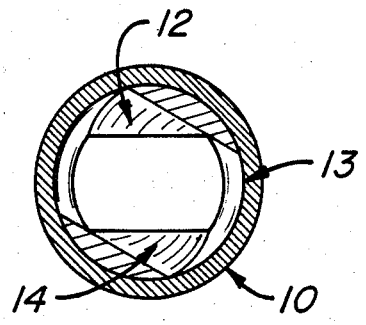
FIG. 4 is a view from the inlet port of a second embodiment of the alignment tube of the present invention showing a spiraling of the tapered ramps.

The alignment tube includes a rigid tubular housing in the form of a wall 13, preferably circular in cross-section, as shown. The wall may be constructed of any suitable material, stainless steel or molded polyurethane being preferred. Included in the interior of the wall are a pair of ramps 12 and 14 which preferably extend nearly the full length of the tube from inlet port 11 to outlet port 15. The ramps each define a planar surface for the contacting of onions propelled down the tube, the planar surfaces tapering in converging relationship one to the other from adjacent the inlet to adjacent the outlet thus forming an outlet which is substantially equal to and only slightly greater in height than the thickness of the pre-cut onion. The tapering of the ramps preferably ends approximately six inches from the outlet to prevent wobbling of the onion as it exits the tube. Ramps 12 and 14 may be integral with the housing 13 and intersect the housing at the interior of the circular wall of the housing. The ramps are immovable relative to one another to permit precise orientation of the onion and are parallel to one another in cross-section, as shown to advantage in FIGS. 2 and 3. It is contemplated that the ramps might each be spiraled slightly adjacent the inlet of the tube, as shown in FIG. 4, to assist in the aligning procedure, the spiralling permitting free access for rotation of the onion, as needed. It is to be noted that the width of the outlet, ie. the distance between concave interior walls 13 of tube 10, is greater than the height of the outlet, ie. the distance between ramps 12 and 14, of the tube to permit rotation of the onion as may be needed for proper alignment.

Tube 10 both aligns the onion and causes the onions to enter the cutter 40 in single file. An onion may enter the alignment tube in any conceivable position, as it is carried by the water. Because of the converging ramps, each onion is forced by the water into an exit position, as shown in FIGS. 1 and 3, ie., a position where the longitudinal axis of the onion is substantially transverse to the ramps and to the individual, horizontally oriented, vertically stacked knives 44 of the cutter. The width of tube 10 is sufficient for even the largest onion, and while the walls of the tube are preferably concave, it is obvious that other designs might suffice.

Figure 5:
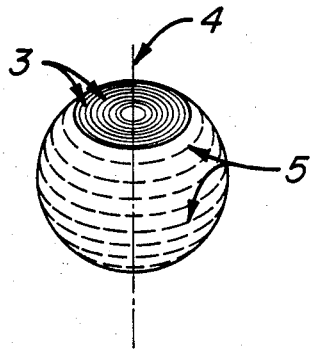
FIG. 5 is a perspective view of an onion showing natural concentric sections and showing the cuts of the knives, by dotted lines, for production of onion rings.

In that the height of the exit port 15 of tube 10 is the same as the exiting onions, each onion is precisely positioned for entering the cutting knives 44. The cutting knives are horizontally placed and vertically stacked at a selected distance from one another to cut onion rings of precise thickness, as shown in FIG. 5. Longitudnal axis 4, being transverse to the knives, permits the tight concentric layers 3 of the onion 2 to be served into sections 5 at substantial right angles to the longitudinal axis for quality production of onion rings. The propelling force of the water, together with the momentum of the onion, forces the onion into contact with the knives for complete horizontal separation of the concentric layers of onion. While the impact is also sufficient for separation of some of the concentric layers to produce onion rings, other separation may be provided by conventional means.

Upon exiting the cutter 40, the onion rings are separated from the water, which may be recycled, and the onion rings are then further processed for consumption.

Having thus described in detail the method of the present invention and a preferred selection of embodiments of the alignment tube of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. A method for cutting onions into onion rings comprising the steps of:

cutting the top and bottom portions off the onion to define an onion having a preselected thickness from top to bottom, said thickness being less than the width of the onion;

propelling the onion so cut in a fluid stream through a flow tube;

aligning the onion within said tube to a preselected exit position; and feeding the onion so aligned into a plurality of cutting knives for cutting the onion into rings.

2. The method as described in claim 1 wherein said first cutting step comprises orienting the onion about its longitudinal axis and cutting the onion to define an onion having planar and parallel opposing surfaces, transverse to the longitudinal.

3. The method as described in claim 1 wherein said propelling step comprises inserting the onion into a fluid medium and forcing said medium with said onion into a flow tube by hydraulic pressure.

4. The method as described in claim 1 wherein said aligning step comprises the forming of the tube into planar converging ramps to define a tube exit port having substantially the same height as the pre-cut onion and forcing the onion into engagement with the ramps and through the tube.

5. The method as described in claim 1 wherein said final cutting step comprises orienting a plurality of cutting knives into a vertically spaced and parallel relationship with one another and into substantially transverse relationship relative to the onion.

6. A method for cutting onions into onion rings comprising the steps of:

cutting the top and bottom portions off the onion to define an onion having parallel and planar opposing surfaces substantially transverse to the longitudinal axis of the onion and to define an onion having a predetermined thickness, the thickness being less than the width of the onion;

placing the onion, so cut, into a water medium;

propelling the water and onion into a flow tube;

aligning the onion within the flow tube for preselected positioning of the onion upon exit from the flow tube; and cutting the onion so aligned into onion rings by forcing the onion through a plurality of parallel spaced knives, vertically stacked, and transversely mounted relative to the longitudinal axis of the onion.

7. In hydraulic food product cutting apparatus including a food cutter, an onion centering and alignment tube for the production of onion rings from onions cut to a pre-selected thickness, said onion alignment tube comprising:

a tubular housing defining a conduit having an inlet port and an outlet port, said outlet port positioned adjacent the cutter; and a pair of oppositely disposed ramps contained within said conduit, said ramps immovably secured to said housing, and said ramps tapered toward one another; the outlet port having an height substantially equal to the thickness of the pre-cut onion and having a width greater than the height of said outlet port.

8. The alignment tube as described in claim 7 wherein said ramps are integral with said housing.

9. The alignment tube as described in claim 7 wherein opposing surfaces of said ramps are parallel in cross-section.

10. The alignment tube as described in claim 7 wherein said ramps with said housing define a spiraled conduit.

11. The alignment tube as described in claim 7 wherein each of said ramps includes a planar onion engaging surface.

12. The alignment tube as described in claim 7 wherein each of said ramps are provided with planar surfaces and wherein the interior side walls of said housing extending between said ramps defines a concave curvature.

13. The alignment tube as described in claim 7 wherein each of said ramps extend substantially the length of said tubular housing.

14. The alignment tube as described in claim 7 wherein each of said ramps intersect the wall of said housing.

* * * * *